US007507934B2

(12) United States Patent
Kondou et al.

(10) Patent No.: US 7,507,934 B2
(45) Date of Patent: Mar. 24, 2009

(54) PLASMA GENERATION ELECTRODE, PLASMA REACTOR, AND EXHAUST GAS CLEANING APPARATUS

(75) Inventors: Atsuo Kondou, Okazaki (JP); Yasumasa Fujioka, Nagoya (JP); Masaaki Masuda, Nagoya (JP); Kenji Dosaka, Wako (JP); Keizo Iwama, Wako (JP)

(73) Assignees: NGK Insulators, Ltd., Nagoya (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/717,725

(22) Filed: Mar. 14, 2007

(65) Prior Publication Data

US 2007/0221633 A1 Sep. 27, 2007

(30) Foreign Application Priority Data

Mar. 24, 2006 (JP) ..... 2006-083530

(51) Int. Cl.
*H05B 1/02* (2006.01)

(52) U.S. Cl. ..... 219/121.37; 219/121.43; 219/121.52; 204/164; 156/345.47

(58) Field of Classification Search ..... 219/121.37, 219/121.38, 121.52, 121.36, 121.59, 121.48, 219/121.51, 74, 75, 202–206; 313/231.31, 313/231.41; 315/111.21, 111.51; 204/164; 156/345.45, 345.47

See application file for complete search history.

(56) References Cited

U.S. PATENT DOCUMENTS

2004/0079631 A1* 4/2004 Birckigt et al. ..... 204/164

FOREIGN PATENT DOCUMENTS

JP A 2001-164925 6/2001
WO WO 2005/001249 A1 1/2005

* cited by examiner

*Primary Examiner*—Mark H Paschall
(74) *Attorney, Agent, or Firm*—Oliff & Berridge, PLC

(57) ABSTRACT

A plasma generation electrode capable of subjecting predetermined components contained in a fluid to be treated to their respective reaction treatments with plasmas having different intensities optimized on a reaction basis, by passing merely once the fluid to be treated, is provided. In the plasma generation electrode, a unit electrode is composed of a tabular ceramic material serving as a dielectric material and an electrically conductive film disposed in the inside of the ceramic material, a plurality of unit electrodes are layered at a constant spacing, the distance between the electrically conductive films disposed in the unit electrodes adjacent to each other is varied partly or the dielectric constant of the ceramic material constituting the unit electrode is varied partly, and plasmas having different intensities can be generated partly in the spaces.

11 Claims, 8 Drawing Sheets

PLASMA GENERATION ELECTRODE, PLASMA REACTOR, AND EXHAUST GAS CLEANING APPARATUS

BACKGROUND OF THE INVENTION

1. Field of the Invention

The present invention relates to a plasma generation electrode, a plasma reactor, and an exhaust gas cleaning apparatus. In particular, it relates to a plasma generation electrode capable of subjecting a plurality of predetermined components contained in a fluid to be treated to their respective reaction treatments with plasmas having intensities optimized on a reaction basis, by passing merely once the fluid to be treated through spaces, in which plasmas are generated, as well as a plasma reactor, and an exhaust gas cleaning apparatus.

2. Description of the Related Art

It is known that silent discharge is generated by placing a dielectric material between two electrodes and applying a high-voltage alternating current or a periodic pulse voltage, and in the plasma field resulting therefrom, active species, radicals, and ions are generated so as to facilitate reaction and decomposition of a gas. Furthermore, it is known that this can be used for removing hazardous components contained in engine exhaust gases and various incinerator exhaust gases.

For example, plasma reactors and the like have been disclosed, in which engine exhaust gases and various incinerator exhaust gases are allowed to pass through plasma fields and, thereby, $NO_X$, carbon fine particles, HC, CO, and the like contained in the engine exhaust gases and various incinerator exhaust gases are treated (refer to Japanese Patent Application Laid-Open No. 2001-164925, for example)

However, since the magnitude of discharge voltage suitable for the treatment with the plasma is different between the above-described $NO_X$, carbon fine particles, and the like, when these components in an exhaust gas are treated, a plurality of plasma reactors must be used independently, or a plasma must be generated in accordance with the condition for the largest discharge voltage. There are problems in that if a plurality of plasma reactors are used, the installation cost is increased, and if the discharge voltage is set at a large value, the energy loss is increased.

On the other hand, plasma reactors and the like have been disclosed, in which a plurality of component gases in a fluid to be treated, e.g., an engine exhaust gas, can be efficiently treated with one plasma reactor by using a plurality of plasmas having different intensities optimized on a reaction basis (refer to International Patent Publication WO 2005/001249 Pamphlet, for example).

As shown in FIG. 12(*a*) and FIG. 12(*b*), for example, the invention described in International Patent Publication WO 2005/001249 relates to a plasma generation electrode 201 including a plurality of unit electrodes 202 hierarchically layered at a predetermined spacing, a space V, in which both ends in one direction (gas passing direction) P are opened and both ends of the other direction (closing direction) Q are closed, is disposed between the unit electrodes 202, and a plasma can be generated in the space V by application of a voltage between the unit electrodes 202. In this plasma generation electrode 201, the unit electrode 202 is composed of a tabular ceramic material 203 serving as a dielectric material and an electrically conductive film 204 disposed in the inside of the ceramic material 203 and, in addition, the unit electrodes 202 include deficient unit electrodes 202*b* having a portion, in which no electrically conductive film 204 is present, somewhere in between one end and the other end in one direction P and normal unit electrodes 202*a* not having a portion in which no electrically conductive film 204 is present. Furthermore, the spaces V include a plurality of normal spaces Va disposed between the normal unit electrode 202*a* and the deficient unit electrode 202*b* facing each other or between the deficient unit electrodes 202*b* facing each other in such a way that the distance between the electrically conductive films 204 becomes equal to the distance between the unit electrodes 202 and a plurality of deficient spaces Vb disposed between the normal unit electrodes 202*a* facing each other with a deficient portion in the deficient unit electrode therebetween in such a way that the distance between the electrically conductive films 204 becomes larger than the distance between the electrically conductive films 204 in the normal space Va. In this manner, since the distance between the electrically conductive films 204 constituting the unit electrodes 202 for generating a plasma in the normal space Va is different from that in the deficient space Vb, the intensity of the plasma generated in the normal space Va is allowed to become different from that in the deficient space Vb. Consequently, it becomes possible to efficiently treat a plurality of predetermined components, which are contained in the fluid to be treated, with plasmas having intensities optimized on a reaction basis, by passing merely once the fluid to be treated. Here, FIG. 12(*a*) and FIG. 12(*b*) schematically show a known plasma generation electrode. FIG. 12(*a*) is a sectional view of the section cut along a plane perpendicular to one direction (gas passing direction). FIG. 12(*b*) is a sectional view of the section taken along a line B-B' shown in FIG. 12(*a*).

As described above, according to the plasma generation electrode 201 shown in FIG. 12(*a*) and FIG. 12(*b*), since the distance between the electrically conductive films 204 constituting the unit electrodes 202 for generating a plasma in the normal space Va is different from that in the deficient space Vb, the intensity of the plasma generated in the normal space Va is allowed to become different from that in the deficient space Vb. However, there is a special relationship between the distance W1 between the unit electrodes 202 in the normal space Va and the distance W2 between the unit electrodes 202 in the deficient space Vb and, therefore, it is not always easy to determine each value independently. Consequently, the individual gas components can be subjected to reaction treatments with approximately suitable plasma intensities, but it is not always easy to subject the individual gas components to reaction treatments with optimized plasma intensities. Here, the above-described special relationship between the distance W1 and the distance W2 is represented by "$W2=W1\times\alpha+T\times(\alpha-1)$, where $\alpha$ is a natural number and T is the thickness of the unit electrode". This refers to that since the deficient space Vb is disposed by dropout of a part of the unit electrode 202, the distance W2 must take on a limited value, the sum of W1 multiplied by a natural number and T multiplied by (a natural number −1), relative to the distance W1 and the thickness T of the unit electrode.

Since the plasma generation electrode must be supported in such a way that a plurality of types of distances between the unit electrodes are ensured, the support structure tends to become complicated.

As shown in FIG. 13(*a*) and FIG. 13(*b*), for example, International Patent Publication WO 2005/001249 discloses a plasma generation electrode 211, in which unit electrodes 212 include normal unit electrodes 212*a* and deficient unit electrodes 212*b*, and the deficient unit electrode 212*b* is formed by dropout of merely a part of an electrically conductive film 204 constituting the unit electrode 212. Here, FIG. 13(*a*) and FIG. 13(*b*) schematically show a known plasma generation electrode. FIG. 13(*a*) is a sectional view of the section cut along a plane perpendicular to one direction (gas passing direction). FIG. 13(*b*) is a sectional view of the section taken along a line C-C' shown in FIG. 13(*a*). In this aspect, a ceramic material 213 has no deficient portion. Consequently, the support structure becomes simple, and this is favorable from the view point of the support of plasma generation electrode. However, the relationship between the distance W3 between the unit electrodes 212 in the normal space Va and the distance W4 between the unit electrodes 212 in the deficient space Vb is similar to the above-described special relationship between the distance W1 and the distance W2. Therefore, likewise, it is not always easy to determine the intensity of plasma generated in the normal space Va and that in the deficient space Vb independently.

SUMMARY OF THE INVENTION

The present invention has been made in consideration of the above-described problems. Accordingly, it is an object of the present invention to provide a plasma generation electrode capable of subjecting efficiently a plurality of predetermined components contained in a fluid to be treated to their respective reaction treatments with plasmas having intensities optimized on a reaction basis, by passing merely once the fluid to be treated through spaces, in which plasmas are generated, as well as a plasma reactor and an exhaust gas cleaning apparatus.

In order to achieve the above-described object, the present invention provides the following plasma generation electrode, plasma reactor, and exhaust gas cleaning apparatus.

A first aspect of the invention provides a plasma generation electrode including a plurality of unit electrodes hierarchically layered at a predetermined spacing and spaces, which are disposed between the above-described unit electrodes and in which at least one end in one direction (gas passing direction) is opened and both ends of the other direction are closed, the plasma generation electrode being capable of generating plasmas in the above-described spaces by application of a voltage between the unit electrodes, wherein the above-described unit electrode is composed of a tabular ceramic material serving as a dielectric material and an electrically conductive film disposed in the inside of the above-described ceramic material, a plurality of the above-described unit electrodes are layered at a constant spacing, the distance between the above-described electrically conductive films adjacent to each other is varied partly or the dielectric constant of the ceramic material constituting the above-described unit electrode is varied partly, and plasmas having different intensities can be generated partly in the above-described spaces.

According to a second aspect of the invention, in the plasma generation electrode according to the first aspect, the dielectric constant of the ceramic material in the portion from the one end side up to a 10-percent to 90-percent point of the entire length of each of the above-described unit electrodes in the above-described gas passing direction may be different from the dielectric constant of the ceramic material in the remaining portion of the above-described unit electrode.

According to a third aspect of the invention, in the plasma generation electrode according to the first aspect, the distance between the above-described electrically conductive films adjacent to each other in the portion from the one end side up to a 10-percent to 90-percent point of the entire length in the above-described gas passing direction may be different from the distance between the above-described electrically conductive films adjacent to each other in the remaining portion.

According to a fourth aspect of the invention, in the plasma generation electrode according to the third aspect, with respect to the above-described electrically conductive films in the above-described remaining portion, the distance between the above-described electrically conductive films adjacent to each other may be further varied partly.

According to a fifth aspect of the invention, in the plasma generation electrode according to the first aspect, at least a part of successive three layers of unit electrodes may be disposed in such a way that the distance between an electrically conductive film disposed in a unit electrode (second unit electrode) constituting the middle layer and an electrically conductive film disposed in a unit electrode (first unit electrode) constituting the layer on one surface side of the above-described second unit electrode is different from the distance between the electrically conductive film disposed in the above-described second unit electrode and an electrically conductive film disposed in a unit electrode (third unit electrode) constituting the layer on the other surface side of the above-described second unit electrode, one end side in the above-described gas passing direction of a space (first space) disposed between the above-described first unit electrode and the second unit electrode is closed, the other end side in the above-described gas passing direction of a space (second space) disposed between the above-described second unit electrode and the third unit electrode is closed, at least one through hole in the direction of the normal is disposed in the above-described second unit electrode, and the gas is allowed to enter from the non-closed end side of the above-described first space, pass the above-described through hole, and exit from the non-closed end side of the second space.

According to a sixth aspect of the invention, in the plasma generation electrode according to the first aspect, the distance between the above-described electrically conductive films adjacent to each other is constant throughout the electrically conductive films, and the distance between a part of the electrically conductive films adjacent to each other is different from the distance between the other electrically conductive films adjacent to each other.

A seventh aspect of the invention provides a plasma reactor including the plasma generation electrode according to any one of the first to sixth aspects, wherein when a gas containing predetermined components is introduced into the above-described spaces disposed between a plurality of the above-described unit electrodes constituting the above-described plasma generation electrode, the above-described predetermined components in the above-described gas can be reacted by plasmas generated in the above-described spaces.

According to an eighth aspect of the invention, in the plasma reactor according to the seventh aspect, when the above-described gas containing the predetermined components is introduced into the above-described spaces, preferably, each of the gas components is reacted in a portion where the intensity of a plasma is suitable for the reaction of each of the gas components, while plasmas having different intensities are generated partly in the above-described spaces.

A ninth aspect of the invention provides an exhaust gas cleaning apparatus including the plasma reactor according to the seventh or eighth aspect and a catalyst, wherein the above-described plasma reactor and the above-described catalyst are disposed in the inside of an exhaust system of an internal-combustion engine.

In the plasma generation electrode according to an aspect of the present invention, individual unit electrodes are layered at a constant spacing, and the distance between the electrically conductive films disposed in the unit electrodes adjacent to each other is varied partly, or the dielectric constant of the ceramic material constituting the unit electrode is varied partly. Therefore, plasmas having different intensities can be generated partly in the space disposed between the unit electrodes adjacent to each other. Since the plasma reactor according to an aspect of the present invention is allowed to include the above-described plasma generation electrode, when a gas containing predetermined components is introduced into the reactor, each of the gas components can be subjected to an efficient reaction treatment with the generated plasma having an optimized intensity. Furthermore, since the exhaust gas cleaning apparatus according to an aspect of the present invention is allowed to include the plasma reactor according to an aspect of the present invention and the catalyst, when the exhaust gas cleaning apparatus is disposed in the inside of an exhaust system of an internal-combustion engine, an exhaust gas can be cleaned efficiently.

DESCRIPTION OF THE PREFERRED EMBODIMENTS

Figure 1A:
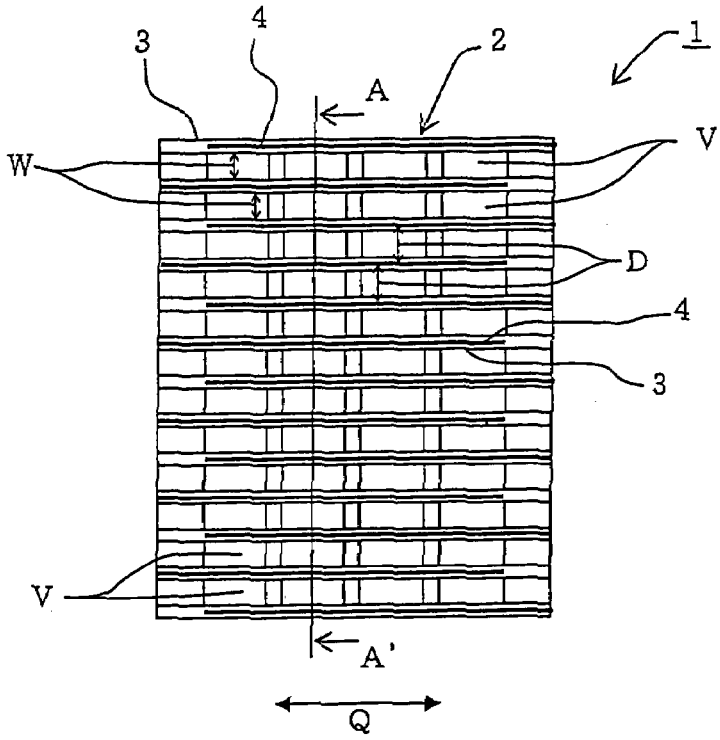
FIGS. 1(*a*)(*b*) schematically show a plasma generation electrode according to an embodiment of the present invention, FIG. 1(*a*) is a sectional view of the section cut along a plane perpendicular to one direction (gas passing direction), and FIG. 1(*b*) is a sectional view of the section taken along a line A-A' shown in FIG. 1(*a*)

The embodiments of the present invention will be described below in detail with reference to the drawings. However, it should be understood that the present invention is not limited to the following embodiments, and changes in design and modifications could be made appropriately based on a common knowledge of a person skilled in the art without departing from the spirit and scope of the present invention. In the individual drawings, the same constituent elements are indicated by the same reference numerals.

Figure 1B:
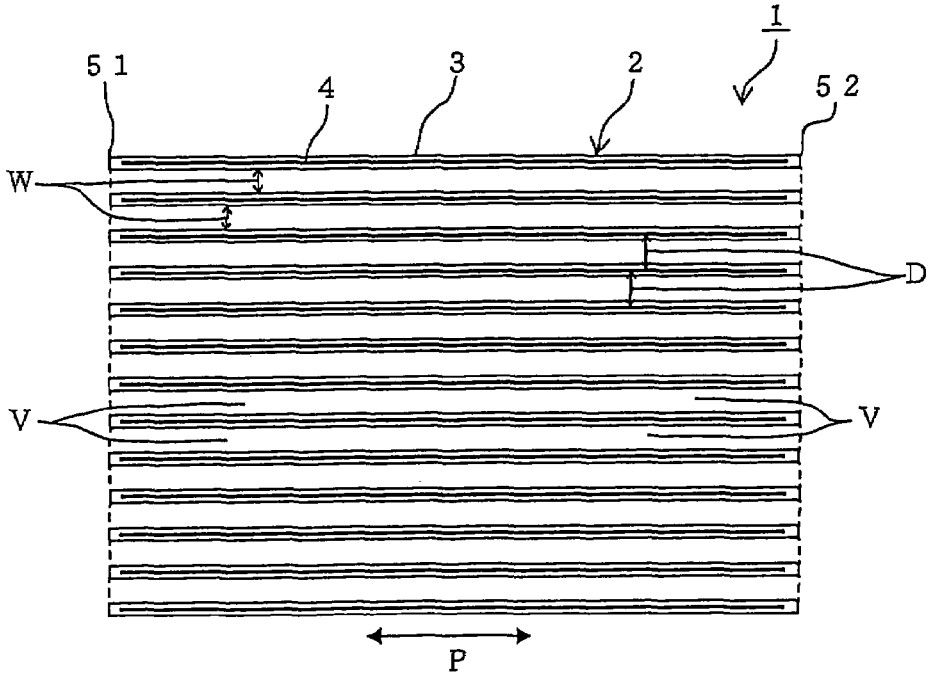
Figure 2:
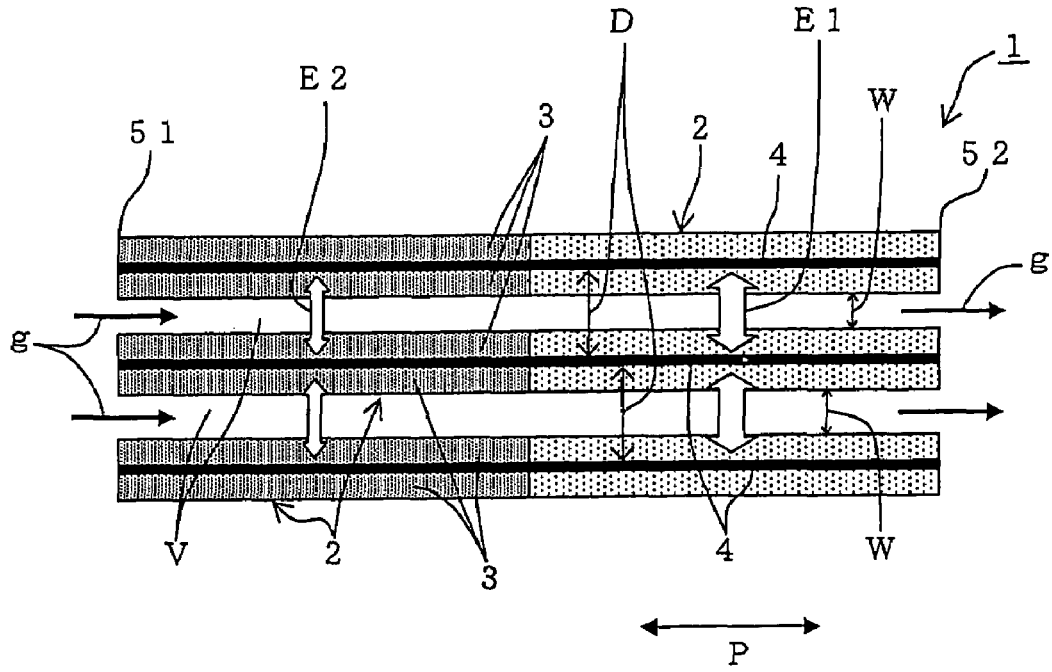
FIG. 2 shows a part of a plasma generation electrode according to an embodiment of the present invention, and is a sectional view schematically showing three unit electrodes adjacent to each other.

FIG. 1(*a*) and FIG. 1(*b*) schematically show a plasma generation electrode according to an embodiment of the present invention. FIG. 1(*a*) is a sectional view of the section cut along a plane perpendicular to one direction (gas passing direction), and FIG. 1(*b*) is a sectional view of the section taken along a line A-A' shown in FIG. 1(*a*). FIG. 2 shows a part of a plasma generation electrode according to an embodiment of the present invention, and is a sectional view schematically showing three unit electrodes adjacent to each other. FIG. 2 is a sectional view of the plasma generation electrode cut along a plane similar to that in the sectional view of the plasma generation electrode shown in FIG. 1(*b*).

As shown in FIG. 1(*a*) and FIG. 1(*b*), a plasma generation electrode 1 of the present embodiment includes a plurality of unit electrodes 2 hierarchically layered at a predetermined spacing and spaces V, in which at least one end in one direction (gas passing direction) P is opened and both ends of the other direction Q are closed, are disposed between the unit electrodes 2. The plasma generation electrode 1 can generate plasmas in the spaces V by application of a voltage between the unit electrodes 2. When the voltage is applied, individual unit electrodes 2 are alternately connected to a power supply side and a ground side.

As shown in FIG. 2, each of the unit electrode 2 constituting the plasma generation electrode 1 of the present embodiment is composed of a tabular ceramic material 3 serving as a dielectric material and an electrically conductive film 4 disposed in the inside of the ceramic material 3. Furthermore, as shown in FIG. 1(*a*), FIG. 1(*b*), and FIG. 2, the dielectric constant of the ceramic material 3 constituting the unit electrode 2 is varied partly, and these unit electrodes are layered so as to constitute the plasma generation electrode 1. Consequently, a plasma E1 and a plasma E2, which have different intensities, can be generated partly in the spaces V. Here, the distance D between the electrically conductive films 4 and 4 disposed in the unit electrodes 2 and 2, respectively, adjacent to each other may be constant or different partly.

When a plurality of unit electrodes 2 are layered at a constant spacing W, the term "spacing W" refers to a distance between the surfaces, which face each other, of unit electrodes 2 and 2 adjacent to each other. This refers to a distance between the surfaces of the ceramic materials 3 and 3, which face each other, of respective unit electrodes 2 and 2.

As described above, in the plasma generation electrode 1 of the present embodiment, the portions having different dielectric constants are formed in one unit electrode, such unit electrodes are layered and, thereby, the intensity of the plasma generated in the spaces V can be varied. Therefore, when the plasma generation electrode 1 of the present embodiment is used for the following plasma reactor or exhaust gas cleaning apparatus, in the treatment of the exhaust gas or the like, a plurality of predetermined components contained in the fluid to be treated can be subjected to their respective reaction treatments with plasmas having intensity optimized on a reaction basis, by passing merely once the fluid to be treated through spaces, in which plasmas are generated. This is also preferable from the view point of support of the plasma generation electrode, because the support structure is simple.

Here, the intensity of plasma refers to discharge energy, a discharge energy density, a discharge voltage, or an electric field intensity in the plasma field, and in consideration of the reactions of individual components in the exhaust gas, a type suitable for controlling the reactivity at an optimum state can be selected as an index thereof.

In the plasma generation electrode 1 of the present embodiment, as shown in FIG. 2, the dielectric constant of a portion from one end (gas inlet end) 51 in the gas passing direction P up to a 50-percent point of the entire length in the gas passing direction P (gas inlet end side 50-percent region) of the ceramic material 3 constituting each of the unit electrodes 2 is different from the dielectric constant of the remaining portion (the other end (gas outlet end) 52 side 50-percent portion (gas outlet end side 50-percent region)) of the ceramic material 3. For example, in the case where the dielectric constant of the gas inlet end side 50-percent region of the ceramic material 3 is low and the dielectric constant of the gas outlet end side 50-percent region of the ceramic material 3 is high, the intensity of a plasma E1 generated in the space V of the remaining portion (gas outlet end side 50-percent region) becomes higher than the intensity of a plasma E2 generated in the space V of the gas inlet end side 50-percent region. When the intensities of the plasmas E1 and E2 are set at the intensities suitable for reactions of the individual components contained in the exhaust gas to be treated, with respect to a gas g, which is allowed to enter from the gas inlet end 51, pass through the space V, and exit from the gas outlet end 52, components which are easy to react by the intensity of the plasma E2 react first and, thereafter, other components which are easy to react by the intensity of the plasma E1 react. The intensities of the plasmas E1 and E2 can be optimized for the reactions of the individual gas components to be treated by setting the dielectric constants of the ceramic material 3 in the gas inlet end side 50-percent region and the gas outlet end side 50-percent region at optimum values for the reactions of the components to be treated.

In the present embodiment, two types of ceramic materials 3, each having a length 50% of the entire length, are disposed in the gas passing direction P. However, each length is not limited to 50% of the entire length, but can be selected at will. Preferably, the length of one ceramic material in the gas passing direction P is 10% to 90% of the entire length. If the length is less than 10%, it may become difficult to generate a plasma having a predetermined intensity stably. The types of the ceramic material 3 are not limited to two types, and three types or more of ceramic materials can be used at will in accordance with the types of exhaust gas components to be treated. In this case, it is preferable that the length of each ceramic material in the gas passing direction P is 10% or more of the entire length because a plasma having a predetermined intensity is generated stably.

Preferably, the distance W between the unit electrodes 2 and 2 adjacent to each other is 0.1 to 3 mm, and more preferably is 0.5 to 1.0 mm. If the distance is less than 0.1 mm, the pressure loss may be increased when the gas passes. If the distance is more than 3 mm, the intensity of plasma may be decreased.

Preferably, the thickness of the electrically conductive film 4 constituting the unit electrode 2 is 0.001 to 0.1 mm, further preferably is 0.005 to 0.05 mm, on the grounds that the plasma generation electrode 1 is miniaturized, the resistance of the fluid to be treated, which is allowed to pass between the unit electrodes 2 and 2, is reduced when an exhaust gas or the like is treated, and the like.

Preferably, the electrically conductive film 4 to be used in the present embodiment contains a metal having excellent electrical conductivity as a primary component. Preferable examples of primary components of the electrically conductive film 4 may include at least one metal selected from the group consisting of tungsten, molybdenum, manganese, chromium, titanium, zirconium, nickel, iron, silver, copper, platinum, and palladium. In the present embodiment, the primary component refers to a component constituting 60 percent by mass or more of the components.

In the unit electrode 2, preferably, the electrically conductive film 4 is disposed by being applied to a tape-shaped ceramic material 3. Specific examples of preferable application method may include printing, roller, spray, electrostatic coating, dipping, and knife coater. According to such a method, the electrically conductive film 4 having excellent surface smoothness after coating and a small thickness can be formed easily.

When the electrically conductive film 4 is applied to the tape-shaped ceramic material, the metal powder described as the primary component of the electrically conductive film 4, an organic binder, and a solvent, e.g., terpineol, are mixed to form a conductor paste, and the resulting paste is applied to the tape-shaped ceramic material 3 by the above-described method, so that the electrically conductive film 4 can be formed. In order to improve the adhesion to the tape-shaped ceramic material 3 and the sinterability, an additive may be added to the above-described conductor paste, if necessary.

The ceramic material 3 (tape-shaped ceramic material) constituting the unit electrode 2 has a function as a dielectric material, as described above. Therefore, when the electrically conductive film 4 is used while being disposed in the inside of the ceramic material 3, one-sided discharge, e.g., arc, can be decreased and small discharges can be generated at a plurality of places as compared with that in the case where discharge is performed by the electrically conductive film 4 alone. In the above-described plurality of small discharges, since a smaller current passes as compared with that in the discharge, e.g., arc, the power consumption can be decreased. Furthermore, since the dielectric material is present, the current passing between the unit electrodes 2 is restricted and, thereby, a nonthermal plasma, in which the temperature is not increased and the energy consumption is small, can be generated.

Preferably, the ceramic material 3 contains a high-dielectric constant material as a primary component. For example, aluminum oxide, zirconium oxide, silicon oxide, mullite, cordierite, titanium-barium based oxide, magnesium-calcium-titanium based oxide, barium-titanium-zinc based oxide, silicon nitride, or aluminum nitride can be used favorably. Preferably, materials suitable for generating plasmas having intensities favorable for the reactions of individual components are selected appropriately among these materials, and these are combined so as to constitute the unit electrodes. Furthermore, by using a material also having excellent thermal shock resistance as a primary component, the plasma generation electrode can be operated under a high-temperature condition as well.

For example, copper metallization can be used as a conductor for a low-temperature fired substrate material (LTCC) in which a glass component has been added to aluminum oxide ($Al_2O_3$). Since the copper metallization is used, the resistance is low and an electrode exhibiting a high discharge efficiency is produced, so that the size of the electrode can be reduced. It becomes possible to design to avoid a thermal stress, and a low-strength problem can be solved. In the case where an electrode is produced from a high-dielectric constant material, e.g., barium titanate, magnesium-calcium-titanium based oxide, and barium-titanium-zinc based oxide, since the discharge efficiency is high, the size of the electrode can be reduced. Therefore, it is possible to carry out structure design in which generation of thermal stress due to high thermal expansion can be reduced.

The dielectric constant of the ceramic material 3 can be determined appropriately in accordance with the intensity of the plasma to be generated. However, in general, it is preferable that the dielectric constant is selected within the range of 2.5 to 50 F/m.

When the ceramic material 3 is formed from a tape-shaped ceramic material, the thickness of the tape-shaped ceramic material is not specifically limited. However, 0.1 to 3 mm is preferable. If the thickness of the tape-shaped ceramic material is less than 0.1 mm, the electrical insulation between a pair of unit electrodes adjacent to each other may not be ensured. If the thickness of the tape-shaped ceramic material exceeds 3 mm, space-saving may be hindered when an exhaust gas cleaning apparatus is produced. In addition, an increase of distance between the electrodes may lead to an increase of load voltage and, thereby, the efficiency may be reduced.

For the tape-shaped ceramic material, a ceramic green sheet for a ceramic substrate can be used favorably. This ceramic green sheet can be formed by molding a slurry or a paste for producing a green sheet following a previously known technique, e.g., a doctor blade method, a calender method, a printing method, or a reverse roll coater method in such a way that a predetermined thickness can be ensured. The thus formed ceramic green sheet may be subjected to working, e.g., cutting, shaving, stamping, communicating hole formation, or the like. Alternatively, a plurality of ceramic green sheets in the layered state may be converted to an integrated laminate through thermal compression bonding or the like so as to be used.

The above-described slurry or the paste for producing a green sheet can be prepared by blending a predetermined ceramic powder with appropriate binder, sintering aid, plasticizer, dispersing agent, organic solvent, and the like so as to be used favorably. Examples of favorable ceramic powders can include powders of alumina, mullite, cordierite, zirconia, silica, silicon nitride, aluminum nitride, ceramic glass, and glass. Examples of favorable sintering aids can include silicon oxide, magnesium oxide, calcium oxide, titanium oxide, and zirconium oxide. Preferably, 3 to 10 parts by mass of sintering aid is added relative to 100 parts by mass of ceramic powder. Plasticizers, dispersing agents, and organic solvents used-in previously known methods can be used as the plasticizer, the dispersing agent, and the organic solvent favorably.

Preferably, the porosity of the ceramic material 3 is 0.1% to 35%, further preferably is 0.1% to 10%. According to such a configuration, a plasma can be generated efficiently between the unit electrodes provided with the ceramic material 3, so that energy conservation can be realized.

Figure 3:
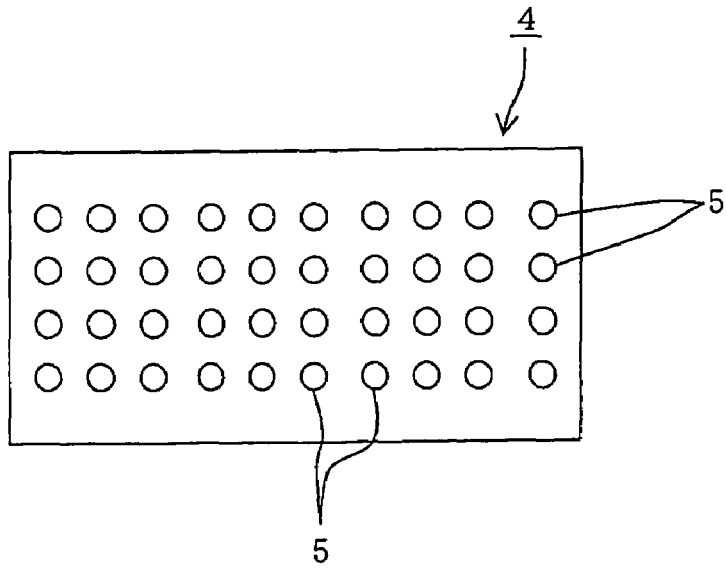
FIG. 3 is a plan view schematically showing an electrically conductive film constituting a plasma generation electrode according to an embodiment of the present invention.

Preferably, at least one of the unit electrodes 2 is composed of the tabular ceramic material 3 serving as a dielectric material and the electrically conductive film 4, which is disposed in the inside of the tabular ceramic material 3 and in which a plurality of through holes 5 penetrating in the film thickness direction as shown in FIG. 3 and having a cross section in the shape partly including a segment of a circle, the cross section being taken along a plane perpendicular to the film thickness direction, are disposed. In FIG. 3, the through holes 5 are arranged in such a way that each hole is positioned at a vertex of a square. However, it is more preferable that each hole is positioned at a vertex of an equilateral triangle. As described above, it is preferable that the through holes 5 are disposed in the electrically conductive film 4 because further uniform discharge can be performed at a low voltage.

The size of the above-described through hole 5 is not specifically limited. For example, it is preferable that the diameter of each through hole 5 is 1 to 10 mm. According to such a configuration, the electric field concentration on the perimeter of the through hole 5 becomes in a condition suitable for discharge, and discharge can be started favorably even when a voltage applied between a pair of unit electrodes 2 is not so high. If the diameter of the through hole 5 is less than 1 mm, the size of the through hole 5 becomes too small, and discharge, which occurs on the perimeter of the through hole 5, becomes in a state similar to a local discharge originating from the above-described point, so that a nonuniform plasma may be generated. If the diameter of the through hole 5 exceeds 10 mm, since discharge is hard to occur in the inside of the through hole 5, the density (intensity) of a plasma generated between a pair of unit electrodes 2 may be decreased.

In the present embodiment, preferably, the distance between the centers of through holes 5 adjacent to each other is determined appropriately in accordance with the diameter of the through hole 5 in such a way that a uniform and high-density (intense) plasma can be generated. For example, it is preferable that the distance between the centers of through holes 5 adjacent to each other is 1.5 to 20 mm, although not specifically limited.

Preferably, the through hole 5 is disposed in such a way that the length of the perimeter of the through hole 5 per unit area is increased. According to such a configuration, the length of nonuniform electric field region, that is, the length of the perimeter serving as a starting point of plasma generation, per unit area can be increased and, thereby, many discharges are allowed to occur per unit area, so that a high-density plasma can be generated. Specific length of the perimeter of the through hole 5 per unit area ($mm/(mm)^2$) can be set appropriately in accordance with the intensity of plasma to be generated and the like. For example, in the case where an exhaust gas of an automobile is treated, it is preferable that the length is 0.05 to 1.7 $mm/(mm)^2$. If the length of the perimeter of the through hole 5 per unit area is smaller than 0.05 mm, a local discharge may occur, and a stable discharge space may not be ensured. If the length exceeds 1.7 mm, the resistance value of the electrically conductive film is increased and the discharge efficiency may be decreased.

In the present embodiment, preferably, the area of the through hole 5 per unit area is 0.1 to 0.98 $(mm)^2/(mm)^2$. If the area is smaller than 0.1 $(mm)^2$, the capacitance of the dielectric electrode is too small and, thereby, a discharge required for the exhaust gas cleaning may become hard to ensure. If the area exceeds 0.98 $(mm)^2$, a uniform discharge effect due to the through hole may become hard to be exerted, and a local discharge may tend to occur.

Preferably, the through holes 5 disposed in the electrically conductive film 4, as shown in FIG. 3, do not overlap with a spacer portion for forming the space V between the unit electrodes 2 when the plasma generation electrode 1, as shown in FIG. 1(*a*), is formed. An abnormal discharge can be suppressed by avoiding overlap between the through holes 5 and the spacer portion.

Figure 4:
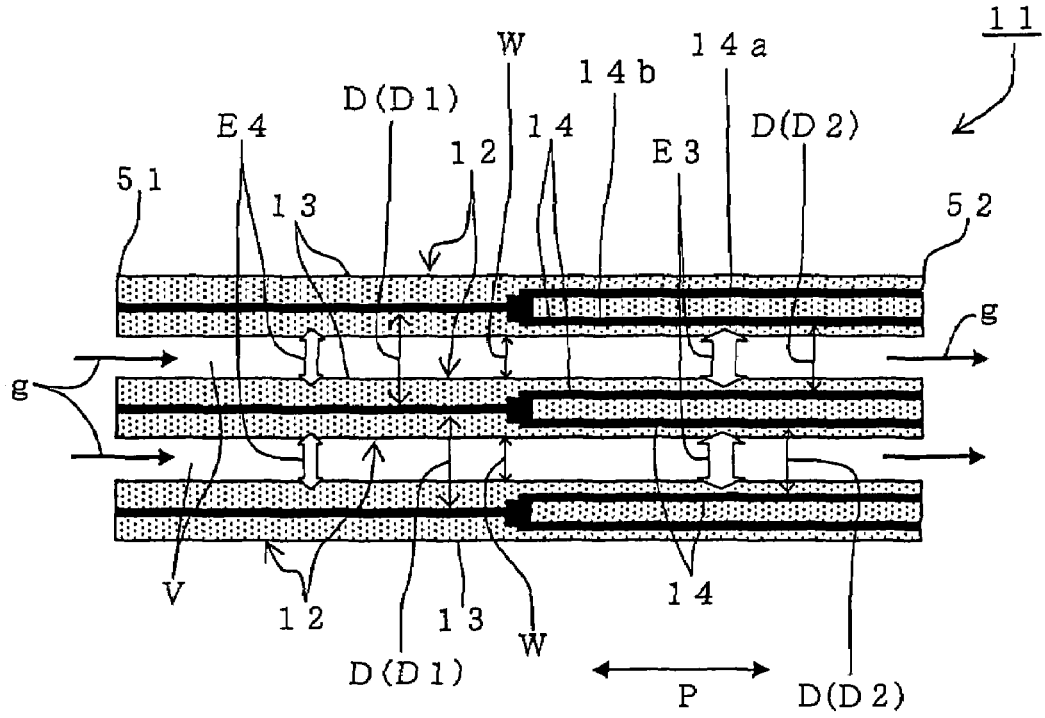
FIG. 4 shows a part of a plasma generation electrode according to another embodiment of the present invention, and is a sectional view schematically showing three unit electrodes adjacent to each other.

A plasma generation electrode according to another embodiment of the present invention will be described below. FIG. 4 shows a part of a plasma generation electrode according to another embodiment of the present invention, and is a sectional view schematically showing three unit electrodes adjacent to each other. FIG. 4 is a sectional view of a plasma generation electrode cut along a plane similar to that in the sectional view of the plasma generation electrode shown in FIG. 1(*b*).

A plasma generation electrode 11 of the present embodiment corresponds to the plasma generation electrode, as shown in FIG. 1(*a*) and FIG. 1(*b*), according to one embodiment of the present invention, except that the unit electrodes 12 having a structure shown in FIG. 4 are disposed in place of the unit electrodes 2 having a structure shown in FIG. 2. Therefore, the plasma generation electrode 11 of the present embodiment is the same as the above-described plasma generation electrode 1 according to one embodiment of the present invention except the configuration of a ceramic material 13 and an electrically conductive film 14 constituting the unit electrode 12.

In the plasma generation electrode 11 of the present embodiment, as shown in FIG. 4, a plurality of unit electrodes 12 are layered at a constant spacing W, and the distance D between the electrically conductive films 14 and 14 disposed in the unit electrodes 12 and 12 adjacent to each other is varied partly. With respect to the distance D between the electrically conductive films 14 and 14 disposed in the unit electrodes 12 and 12 adjacent to each other, the term "distance D" refers to the distance between the surfaces, which face each other, of the electrically conductive films 14 and 14 adjacent to each other disposed in the unit electrodes 12 and 12 adjacent to each other. In the case where a plurality of (in FIG. 4, two layers) electrically conductive films 14*a* and 14*b* are parallel disposed in the unit electrode 12, as shown in FIG. 4 in which the electrically conductive film 14 is disposed in the gas outlet end 52 side, the term "distance D" refers to the distance D2 between electrically conductive films 14 in the unit electrodes 12 and 12 adjacent to each other, each electrically conductive film 14 being located at the position nearest the electrically conductive film 14 in the adjacent unit electrode 12. The case where the distance D between the electrically conductive films 14 and 14 disposed in the unit electrodes 12 and 12 adjacent to each other is varied partly includes the case where in a pair of the unit electrodes 12 and 12 adjacent to each other, the distance D between the electrically conductive films 14 and 14 is varied partly in such a way that the distance D1 and the distance D2 are present, that is, the electrically conductive films 14 and 14 adjacent to each other are disposed in such a way that a plurality of types of spacing (the distance D1 and the distance D2) are allowed, as in the plasma generation electrode 11 shown in FIG. 4 and the case where the distance between the electrically conductive films is constant in a pair of unit electrodes adjacent to each other, but the value is different from the distance between the electrically conductive films in another pair of unit electrodes adjacent to each other, as in the plasma generation electrode shown in FIG. 6 and FIG. 8 described below. Furthermore, both of these configurations may be included.

In this manner, with respect to the plasma generation electrode 11 of the present embodiment, the intensity of a plasma generated in the space V can be varied on the basis of the difference in distance between the electrically conductive films 14 and 14 adjacent to each other. Therefore, when the plasma generation electrode 11 of the present embodiment is used for the following plasma reactor or the exhaust gas cleaning apparatus, in the treatment of the exhaust gas or the like, a plurality of predetermined components contained in the fluid to be treated can be subjected to their respective reaction treatments with plasmas having intensities optimized on a reaction basis, by passing merely once the fluid to be treated through the spaces, in which plasmas are generated.

In the plasma generation electrode 11 of the present embodiment, as shown in FIG. 4, the distance between the electrically conductive films 14 and 14, adjacent to each other, from one end (gas inlet end) 51 in the gas passing direction P up to about 50-percent point of the entire length in the gas passing direction P (gas inlet end side 50-percent region) is different from the distance between the electrically conductive films 14 and 14 adjacent to each other in the remaining portion (the other end (gas outlet end) 52 side about 50-percent portion (gas outlet end side 50-percent region)). This refers to that in the gas outlet end side 50-percent region, two layers of electrically conductive films 14 are parallel disposed in one unit electrode 12 and, thereby, the distance D2 between the electrically conductive films 14 and 14 adjacent to each other is allowed to become smaller than the distance D1 between the electrically conductive films 14 and 14 in the gas inlet end side 50-percent region. Consequently, the intensity of a plasma E3 generated in the space V of the remaining portion (gas outlet end side 50-percent region) becomes higher than the intensity of a plasma E4 generated in the space V of the gas inlet end side 50-percent region. When the intensities of the plasmas E3 and E4 are set at the intensities suitable for reactions of the individual components contained in the exhaust gas to be treated, with respect to a gas g, which is allowed to enter from the gas inlet end 51, pass through the space V, and exit from the gas outlet end 52, components which are easy to react by the intensity of the plasma E4 react first and, thereafter, other components which are easy to react by the intensity of the plasma E3 react. The intensities of the plasmas E3 and E4 can be optimized for the reactions of the individual gas components to be treated by setting the positions and the number of electrically conductive films 14 disposed in the ceramic material 13, and setting the distances between the electrically conductive films 14 and 14 adjacent to each other in the gas inlet end side 50-percent region and the gas outlet end side 50-percent region at optimum values.

In the present embodiment, with respect to a pair of electrically conductive films 14 and 14 adjacent to each other, a portion of the distance D1 and a portion of the distance D2, each having a length 50% of the entire length, are disposed in the gas passing direction P. However, each length is not limited to 50% of the entire length, but can be selected at will. Preferably, the length of one distance (for example, distance D1) in the gas passing direction P is 10% to 90% of the entire length. If the length is less than 10%, it may become difficult to generate a plasma with a predetermined intensity stably. The distances of a pair of electrically conductive films 14 and 14 adjacent to each other are not limited to two types (for example, distance D1 and distance D2), and three types or more of arbitrary distances can be adopted in accordance with the types of exhaust gas components to be treated. In this case, it is preferable that the length of the portion of each distance in the gas passing direction P is 10% or more of the entire length because a plasma having a predetermined intensity is generated stably.

Figure 5:
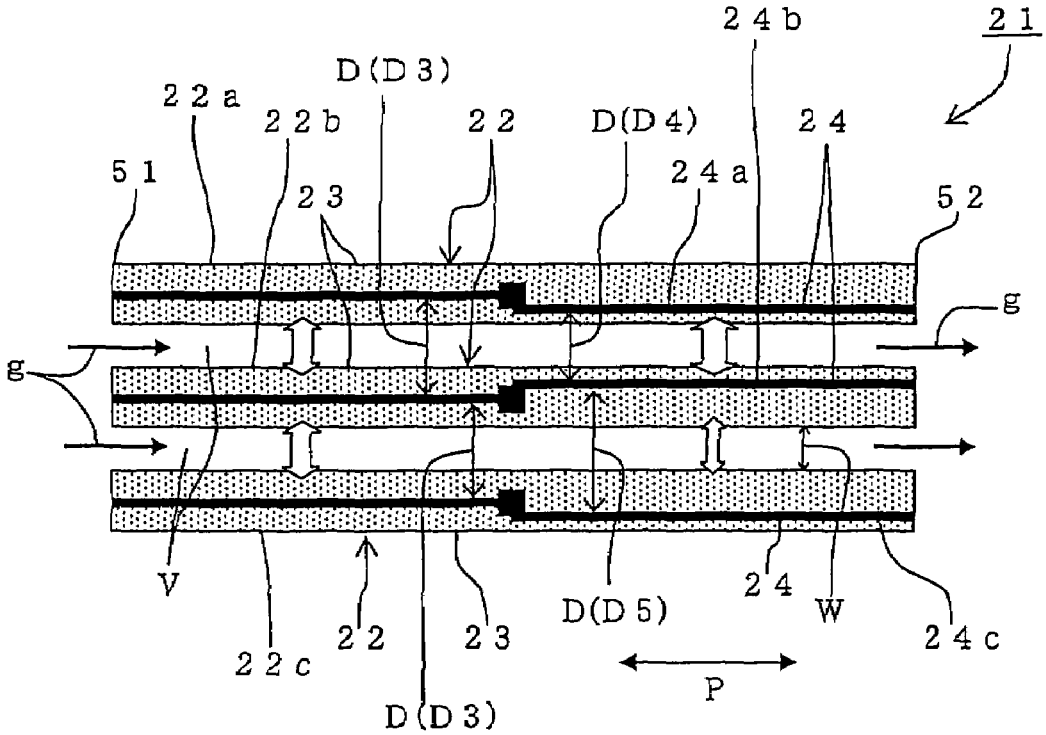
FIG. 5 shows a part of a plasma generation electrode according to another embodiment of the present invention, and is a sectional view schematically showing three unit electrodes adjacent to each other.

A plasma generation electrode according to another embodiment of the present invention will be described below. FIG. 5 shows a part of a plasma generation electrode according to another embodiment of the present invention, and is a sectional view schematically showing three unit electrodes adjacent to each other. FIG. 5 is a sectional view of a plasma generation electrode cut along a plane similar to that in the sectional view of the plasma generation electrode shown in FIG. 1(*b*).

A plasma generation electrode 21 of the present embodiment corresponds to the plasma generation electrode, as shown in FIG. 1(*a*) and FIG. 1(*b*), according to one embodiment of the present invention, except that the unit electrodes 22 having a structure shown in FIG. 5 are disposed in place of the unit electrodes 2 having a structure shown in FIG. 2. Therefore, the plasma generation electrode 21 of the present embodiment is the same as the above-described plasma generation electrode 1 according to one embodiment of the present invention except the configuration of a ceramic material 23 and an electrically conductive film 24 constituting the unit electrode 22.

In the plasma generation electrode 21 of the present embodiment, as shown in FIG. 5, a plurality of unit electrodes 22 are layered at a constant spacing W, and the distance D between the electrically conductive films 24 and 24 disposed in the unit electrodes 22 and 22 adjacent to each other is varied partly. The above-described plasma generation electrode 11, as shown in FIG. 4, has a configuration in which the distance D between the electrically conductive films 14 and 14 adjacent to each other is partly varied by disposing two electrically conductive films 14 partly in the unit electrode 12, whereas in the plasma generation electrode 21 of the present embodiment, the position of disposition of the electrically conductive film 24 in the unit electrode 22 is changed in the thickness direction and, thereby, the distance D between the electrically conductive films 24 and 24 adjacent to each other is varied partly.

In the present embodiment, as shown in FIG. 5, when three unit electrodes 22 adjacent to each other are assumed to be a first unit electrode 22*a*, a second unit electrode 22*b*, and a third unit electrode 22*c* from the top, in the gas inlet end 51 side region, each of the electrically conductive films 24 is disposed in the middle portion of the unit electrode 22 in the thickness direction. Consequently, every distance between the electrically conductive films 24 and 24 adjacent to each other in this region is a distance D3. On the other hand, in the gas outlet end 52 side region, the electrically conductive film 24*a* disposed in the first unit electrode 22*a* is disposed at a position leaning to the side closer to the second unit electrode 22*b* in the direction of thickness of the first unit electrode 22*a*. The electrically conductive film 24*b* disposed in the second unit electrode 22*b* is disposed at a position leaning to the side closer to the first unit electrode 22*a* in the direction of thickness of the second unit electrode 22*b*. Furthermore, the electrically conductive film 24*c* disposed in the third unit electrode 22*c* is disposed at a position leaning to the side farther from the second unit electrode 22*b* in the direction of thickness of the third unit electrode 22*c*. Consequently, the distance between the electrically conductive films 24*a* and 24*b* adjacent to each other becomes a distance D4 smaller than the above-described distance D3, and the distance between the electrically conductive films 24*b* and 24*c* adjacent to each other becomes a distance D5 larger than the above-described distance D3. In this manner, in the plasma generation electrode 21 of the present embodiment, the position of disposition of the electrically conductive film 24 in the unit electrode 22 is changed in the thickness direction and, thereby, the distance D between the electrically conductive films 24 and 24 adjacent to each other is varied partly.

As described above, the plasma generation electrode 21 of the present embodiment vary the intensity of a plasma generated in the space V on the basis of the difference in distance between the electrically conductive films 24 and 24 adjacent to each other, as in the above-described plasma generation electrode 11 shown in FIG. 4.

The configuration of the plasma generation electrode of the present embodiment is the same as that of the above-described plasma generation electrode according to one embodiment of the present invention except those described above.

Figure 6:
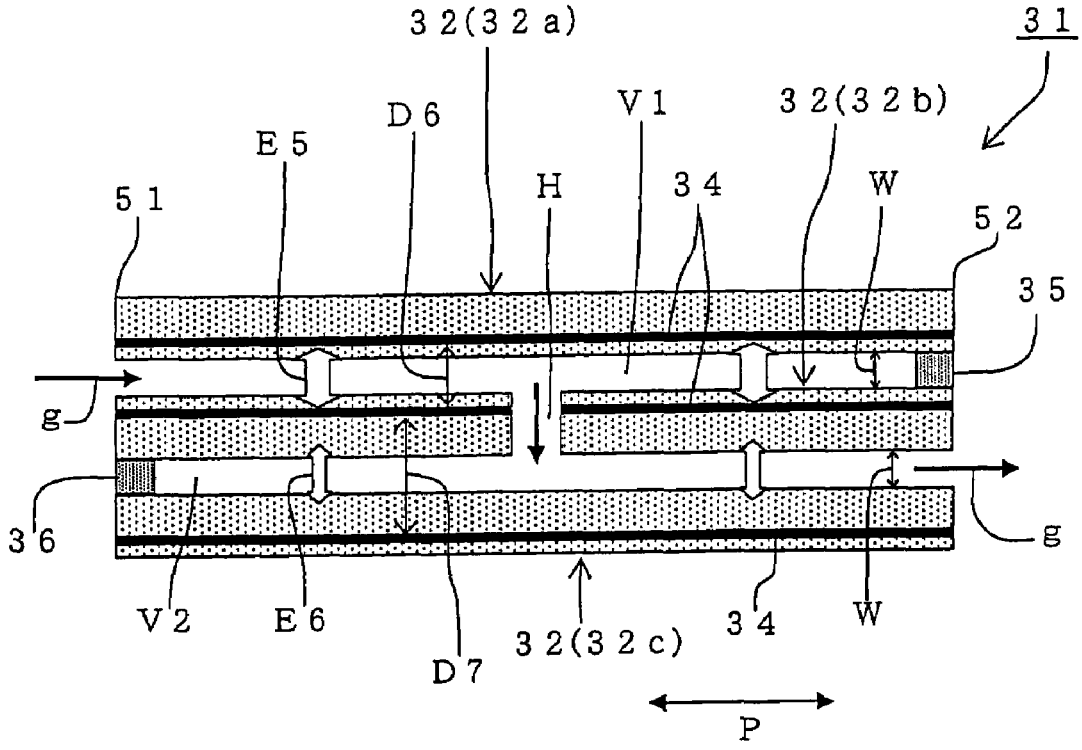
FIG. 6 shows a part of a plasma generation electrode according to another embodiment of the present invention, and is a sectional view schematically showing three unit electrodes adjacent to each other.
Figure 7:
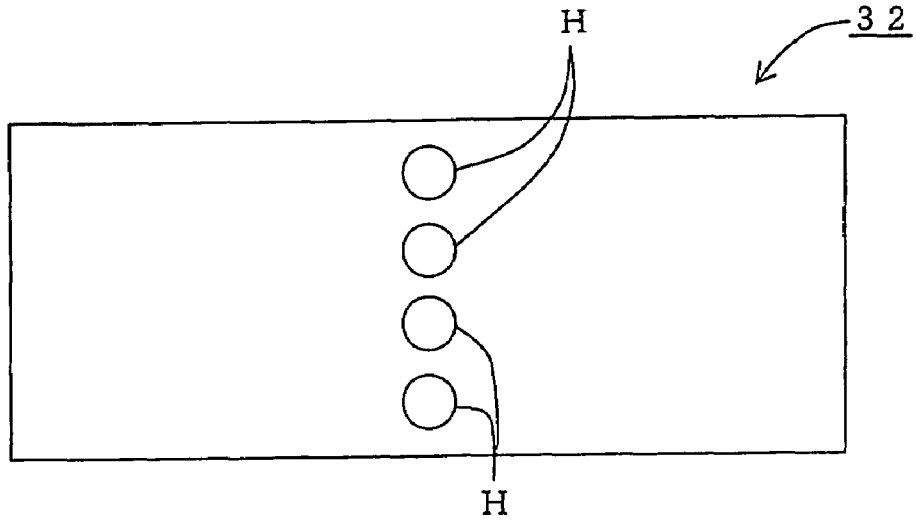
FIG. 7 is a plan view schematically showing a unit electrode to be used in a plasma generation electrode according to another embodiment of the present invention.

A plasma generation electrode according to another embodiment of the present invention will be described below. FIG. 6 shows a part of a plasma generation electrode according to another embodiment of the present invention, and is a sectional view schematically showing three unit electrodes adjacent to each other. FIG. 6 is a sectional view of a plasma generation electrode cut along a plane similar to that in the sectional view of the plasma generation electrode shown in FIG. 1(*b*). FIG. 7 is a plan view schematically showing a unit electrode to be used in a plasma generation electrode according to another embodiment of the present invention.

In a plasma generation electrode 31 of the present embodiment, as shown in FIG. 6, successive three layers of unit electrodes 32 are disposed in such a way that the distance D6 between an electrically conductive film 34 disposed in a unit electrode (second unit electrode) 32*b* constituting the middle layer and an electrically conductive film 34 disposed in a unit electrode (first unit electrode) 32*a* constituting the layer on one surface side of the second unit electrode 32*b* is different from the distance D7 between the electrically conductive film 34 disposed in the second unit electrode 32*b* and an electrically conductive film 34 disposed in a unit electrode (third unit electrode) 32*c* constituting the layer on the other surface side of the second unit electrode 32*b*, one end (in the present embodiment, the gas outlet end 52) side in the gas passing direction P of a space (first space) V1 disposed between the first unit electrode 32*a* and the second unit electrode 32*b* is closed with a closing component 35 and the other end (in the present embodiment, the gas inlet end 51) side in the gas passing direction P of a space (second space) V2 disposed between the second unit electrode 32*b* and the third unit electrode 32*c* is closed with a closing component 36, at least one gas communicating hole H in the direction of the normal is disposed in the second unit electrode 32*b*, and the gas is allowed to enter from the non-closed end (gas inlet end 51) side of the first space V1, pass the gas communicating hole H, and exit from the non-closed end (gas outlet end 52) side of the second space V2. In the plasma generation electrode 31 of the present embodiment, it is essential only that at least a part of successive three layers of unit electrodes 32 have the above-described configuration.

In the plasma generation electrode 31 of the present embodiment, the distance D6 between the electrically conductive films 34 and 34, which are adjacent to each other and which are disposed sandwiching the first space V1, is smaller than the distance D7 between the electrically conductive films 34 and 34, which are adjacent to each other and which are disposed sandwiching the second space V2. Consequently, the intensity of a plasma E5 generated in the first space V1 becomes higher than the intensity of a plasma E6 generated in the second space V2.

When an exhaust gas, for example, is allowed to enter from the gas inlet end 51 of the plasma generation electrode 31 of the present embodiment, the exhaust gas is allowed to enter the first space V1, the gas inlet end 51 side of which is opened, and the predetermined components in the exhaust gas are treated with the plasma E5. Thereafter, the exhaust gas is allowed to pass the gas communicating hole H and enter the second space V2 side. The other predetermined components in the exhaust gas are treated with a plasma E6, and the treated exhaust gas is discharged from the gas outlet end 52 of the second space V2.

It is essential only that the unit electrode 32 to be used in the plasma generation electrode 31 of the present embodiment is provided with at least one gas communicating hole H. For example, as in the unit electrode 32 shown in FIG. 7, four gas communicating holes H may be disposed in the center portion in such a way as to be aligned in a straight line. The positions, the sizes and the number of gas communicating holes are not specifically limited, and can be determined appropriately in accordance with the components contained in the exhaust gas, the contents thereof, the amount of treatment of the exhaust gas, the structure of the plasma generation electrode, and the like.

Preferably, the closing components 35 and 36 are formed from the material similar to that for the ceramic material. The lengths of the closing components 35 and 36 in the gas passing direction P are not specifically limited. The length may be determined appropriately within the range in which passing of the gas is prevented and breakage or the like is hard to occur.

The configuration of the plasma generation electrode of the present embodiment is the same as that of the above-described plasma generation electrode according to one embodiment of the present invention except those described above.

Figure 8:
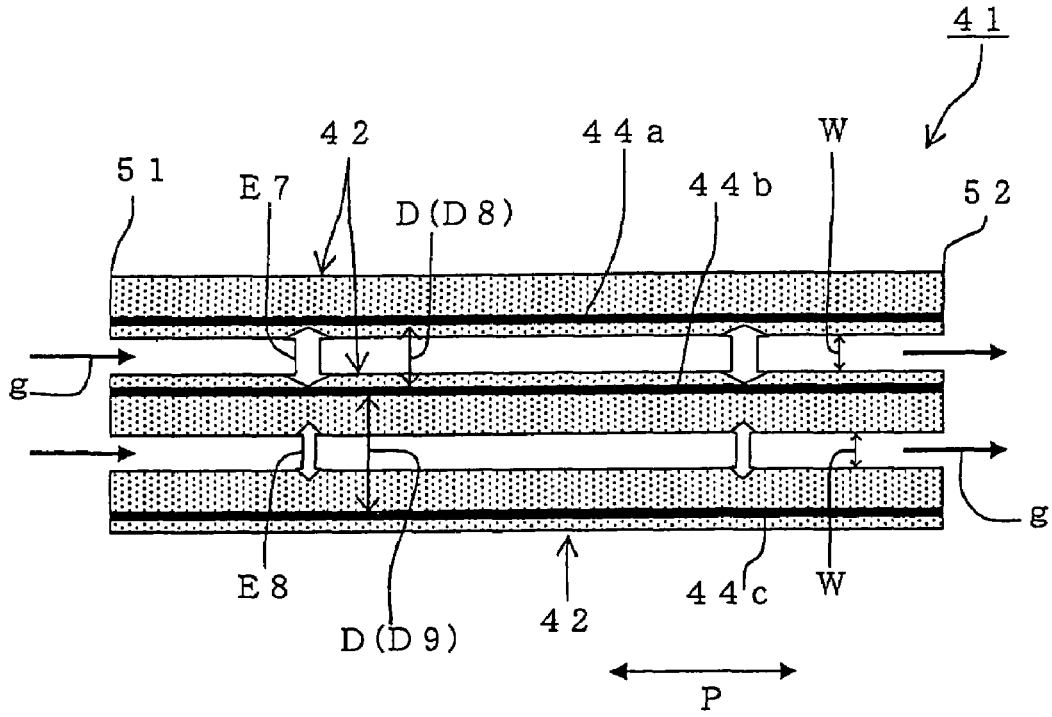
FIG. 8 shows a part of a plasma generation electrode according to another embodiment of the present invention, and is a sectional view schematically showing three unit electrodes adjacent to each other.

A plasma generation electrode according to another embodiment of the present invention will be described below. FIG. 8 shows a part of a plasma generation electrode according to another embodiment of the present invention, and is a sectional view schematically showing three unit electrodes 42 adjacent to each other. FIG. 8 is a sectional view of a plasma generation electrode cut along a plane similar to that in the sectional view of the plasma generation electrode shown in FIG. 1(*b*).

In the plasma generation electrode 41 of the present embodiment, as shown in FIG. 8, the distance D8 between the electrically conductive films 44*a* and 44*b* adjacent to each other is constant all over the electrically conductive films 44*a* and 44*b*, and the distance D8 between a part of the electrically conductive films 44*a* and 44*b* adjacent to each other is different from the distance D9 between the other electrically conductive films 44*b* and 44*c* adjacent to each other. In the present embodiment, the distance D8 is made smaller than the distance D9. Consequently, the intensity of a plasma E7 generated between the electrically conductive films 44*a* and 44*b* adjacent to each other becomes higher than the intensity of a plasma E8 generated between the electrically conductive films 44*b* and 44*c* adjacent to each other.

In the present embodiment, the phrase "the distance D8 between the electrically conductive films 44*a* and 44*b* adjacent to each other is constant all over the electrically conductive films 44*a* and 44*b*" refers to that the distance between the electrically conductive films 44*a* and 44*b* adjacent to each other is constantly D8 at any portion. The phrase "the distance D8 between a part of the electrically conductive films 44*a* and 44*b* adjacent to each other is different from the distance D9 between the other electrically conductive films 44*b* and 44*c* adjacent to each other" refers to that when the distances D8, D9, and the like between the electrically conductive films adjacent to each other are compared, all the distances D between the electrically conductive films do not take on the same value throughout the plasma generation electrode, but the distance D between a part of the electrically conductive films adjacent to each other is allowed to become different from the distance D between the other electrically conductive films in such a way that the distance D8 becomes different from the distance D9.

The configuration of the plasma generation electrode of the present embodiment is the same as that of the above-described plasma generation electrode according to one embodiment of the present invention except those described above.

A method for manufacturing a plasma generation electrode according to an embodiment of the present invention will be specifically described below.

A ceramic green sheet serving as the above-described ceramic material is molded. For example, at least one material selected from the group consisting of alumina, mullite, cordierite, zirconia, silica, silicon nitride, aluminum nitride, ceramic glass, and glass is blended with the above-described sintering aid, the binder, e.g., a butyral based resin and a cellulose based resin, a plasticizer, e.g., DOP and DBP, an organic solvent, e.g., toluene and butadiene, and the like, followed by mixing adequately through the use of an alumina pot and alumina balls, so as to prepare a slurry for producing a green sheet. The slurry may be prepared by ball mill mixing of these materials with the monoball. The unit electrode of the plasma generation electrode of the present embodiment is formed by combining ceramic materials having different dielectric constants. Therefore, a plurality of ceramic green sheets are formed from a plurality of materials for obtaining different predetermined dielectric constants.

Each of the resulting slurry for producing a green sheet is agitated in a vacuum so as to deaerate, and is adjusted to have a predetermined viscosity. Each of the thus prepared slurry for producing a green sheet is molded into the shape of a tape by a tape molding method, e.g., doctor blade method, so that a plurality of types of unfired ceramic are formed.

On the other hand, an electrically conductive paste for forming an electrically conductive film to be disposed on one surface of the resulting unfired ceramic material is prepared. This electrically conductive paste can be prepared by, for example, adding a binder and a solvent, e.g., terpineol, to a silver powder and performing kneading adequately through the use of a triroll mill.

Figure 9:
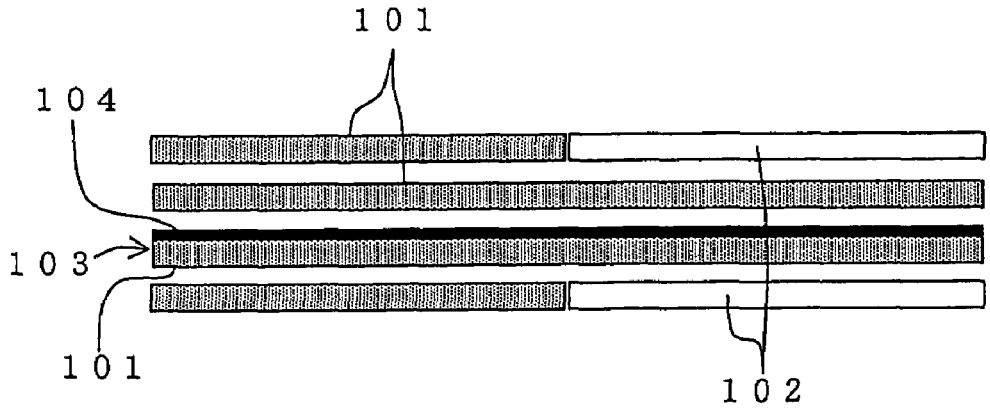
FIG. 9 is a sectional view schematically showing the state, in which unfired ceramic materials and an electrically conductive film are layered, for explaining a production step of a plasma generation electrode according to the present invention.

The thus formed conductor paste is printed on a surface of one unfired ceramic material by using screen printing or the like to form an electrically conductive film in a predetermined shape, so that an unfired ceramic material 103 provided with the electrically conductive film, as shown in FIG. 9, is produced. At this time, in order that electricity can be supplied from the outside of a unit electrode to the electrically conductive film 104 after the unit electrode is formed by sandwiching the electrically conductive film 104 with ceramic materials, preferably, the printing is performed in such a way that the electrically conductive film 104 is disposed while being extended to the perimeter portion of the unfired ceramic material. In the present embodiment, the unfired ceramic material constituting the unfired ceramic material 103 provided with the electrically conductive film is a low-dielectric constant unfired ceramic material 101 which serves as a low-dielectric constant ceramic material after being fired. Here, FIG. 9 is a sectional view schematically showing the state, in which the unfired ceramic materials and the electrically conductive film are layered, for explaining a production step of a plasma generation electrode according to the present invention.

Subsequently, the unfired ceramic material 103 provided with the electrically conductive film and other unfired ceramic materials are layered in such a way as to cover the electrically conductive film printed. As shown in FIG. 9, on the electrically conductive film disposition side surface of the unfired ceramic material 103 provided with the electrically conductive film, the same size of low-dielectric constant unfired ceramic material 101 is disposed. Furthermore, on both surfaces thereof, the low-dielectric constant unfired ceramic materials 101 and high-dielectric constant unfired ceramic materials 102 serving as high-dielectric constant ceramic materials after being fired are disposed in their respective predetermined regions. In the present embodiment, the low-dielectric constant unfired ceramic material 101 and the high-dielectric constant unfired ceramic material 102, each constituting about 50% of the entire area, are disposed on each of the two surfaces. When the unfired ceramic materials are layered, it is preferable that layering is performed while a pressure of 10 MPa is applied at a temperature of 100° C. The unfired ceramic materials layered while sandwiching the electrically conductive film are fired so as to form a unit electrode 2 (refer to FIG. 2) composed of tabular ceramic materials having partly varying dielectric constants and the electrically conductive film. In the resulting unit electrode, the region, in which the high-dielectric constant unfired ceramic materials 102 are disposed, serves as a high-dielectric constant ceramic material as a whole, and the other region serves as a low-dielectric constant ceramic material as a whole. With respect to the dielectric constant, the region, in which four layers of merely low-dielectric constant unfired ceramic materials 101 are layered, exhibits that dielectric constant as a whole. On the other hand, the region, in which two layers of low-dielectric constant ceramic materials and one layer on each of two surfaces, that is, two layers in total of high-dielectric constant unfired ceramic materials 102 are layered, tends to exhibit a dielectric constant nearly midway between the dielectric constant of the low-dielectric constant ceramic material and the dielectric constant of the high-dielectric constant ceramic material.

With respect to the unit electrode 2 shown in FIG. 2, one electrically conductive film in the shape of a flat sheet is disposed in one unit electrode. In the case where electrically conductive films are unevenly disposed in one unit electrode at different positions in the thickness direction, as in the unit electrodes shown in FIGS. 4 to 6 and FIG. 8, the number of layering of the unfired ceramic materials and the arrangement of the electrically conductive films are set in such a way that the configuration of each unit electrode is ensured.

The resulting plurality of unit electrodes are layered. At this time, in order to ensure the predetermined spacing between the individual unit electrodes, ceramic rods in the shape of a quadrangular prism are formed from the same material as that for the above-described ceramic material, and are sandwiched between the individual unit electrodes. The thickness of the ceramic rod at this time becomes the distance between individual unit electrodes. When the ceramic rods are sandwiched between the individual unit electrodes, the ceramic rods are arranged nearly parallel to each other so as to ensure the gas flow path when an exhaust gas or the like is treated. The ceramic rod is not necessarily in the shape of a quadrangular prism, and may be in the shape of a cylinder, a polygonal column, and other columns. A plurality of ribs may be formed on one surface of the above-described ceramic material, the unit electrodes may be layered while sandwiching the ribs so as to form a space. Furthermore, projections and depressions may be formed on the ceramic materials, and these may be stacked so as to form a space. As described above, a plurality of unit electrodes are hierarchically layered with the above-described ceramic rods therebetween and, thereby, the plasma generation electrode of the present embodiment can be produced.

Figure 10:
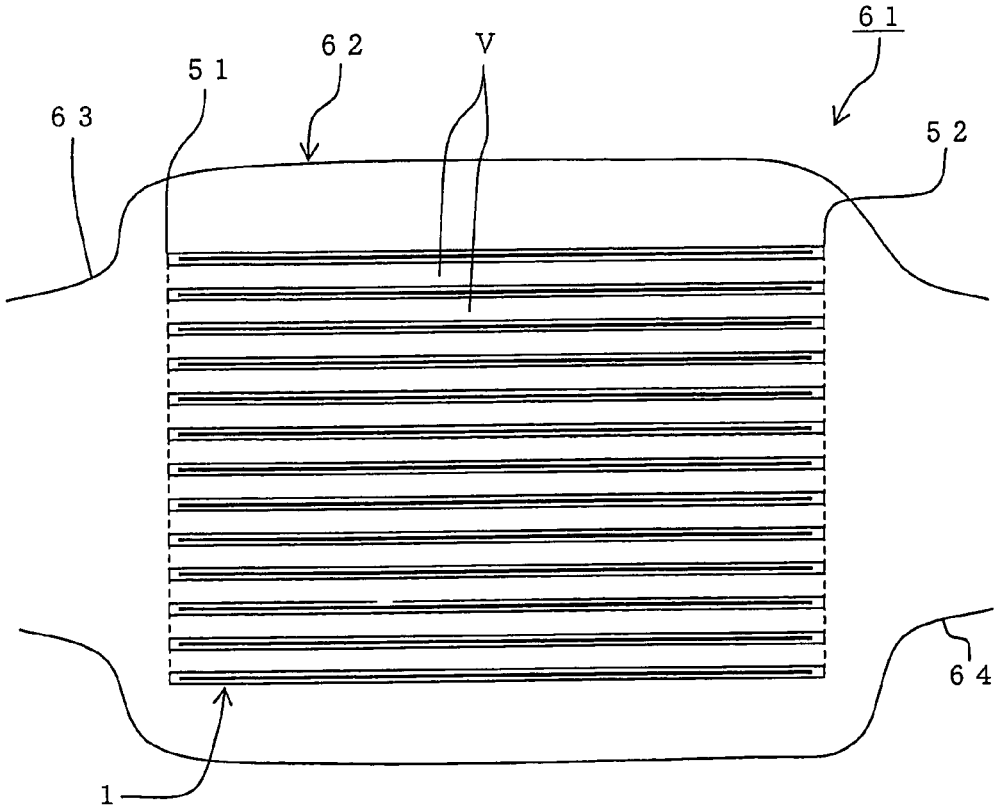
FIG. 10 is a sectional view schematically showing a plasma reactor according to an embodiment of the present invention.

A plasma reactor according to an embodiment of the present invention will be described below. FIG. 10 is a sectional view schematically showing a plasma reactor according to an embodiment of the present invention. As shown in FIG. 10, a plasma reactor 61 of the present embodiment is characterized by including the plasma generation electrode (the plasma generation electrode 1) having the unit electrodes 2, as shown in FIG. 2, according to an embodiment of the present invention, as shown in FIG. 1(*a*) and FIG. 1(*b*). Specifically, the plasma reactor 61 of the present embodiment includes a plasma generation electrode 1 and a case 62 holding the plasma generation electrode 1 in the state in which a gas (a fluid to be treated) containing predetermined components can be introduced into spaces V three-dimensionally arranged between a plurality of unit electrodes 2 constituting the plasma generation electrode 1. This case 62 has an inlet 63, through which the fluid to be treated is allowed to enter, and an outlet 64, through which a treated fluid resulting from a treatment of the entered fluid to be treated by passing between the unit electrodes is discharged. When a gas containing predetermined components is introduced into the spaces V of the thus configured plasma reactor 61 of the present embodiment, the predetermined components in the gas can be reacted by plasmas generated in the spaces V.

Since the plasma reactor 61 of the present embodiment includes the plasma generation electrode 1, as shown in FIG. 1(*a*) and FIG. 1(*b*), having the unit electrodes 2, as shown in FIG. 2, when the fluid to be treated is allowed to enter from the inlet 63 and pass through the gas inlet end 51 side region, in which the dielectric constant of the ceramic material is low, the materials, e.g., $NO_X$, which reacts by a plasma having small energy, are decomposed by the weak plasma E2 (refer to FIG. 2). When the fluid to be treated is allowed to pass through the gas outlet end 52 side region, in which the dielectric constant of the ceramic material is high, the materials, e.g., particles, which require a plasma having large energy for the reactions, are decomposed by the intense plasma E1 (refer to FIG. 2). In this manner, according to the plasma reactor of the present embodiment, when the fluid to be treated is allowed to pass through the spaces in which plasmas are generated, a plurality of predetermined components contained in the fluid to be treated can be treated efficiently with a plurality of plasmas having different intensities optimized on a reaction basis, by passing merely once a fluid to be treated.

When the plasma generation electrode 1 is disposed in the plasma reactor 61 of the present embodiment, preferably, an insulating and heat-resistant buffering agent is interposed between the case 62 and the plasma generation electrode 1.

The material for the case 62 used in the present embodiment is not specifically limited. For example, ferrite based stainless steel is preferable because of excellent electrical conductivity, light weight, low cost, and small deformation with thermal expansion.

The thus configured plasma reactor 61 can be used by, for example, being disposed in an exhaust system of an automobile. An exhaust gas is allowed to pass through plasmas generated in the spaces V disposed between the unit electrodes and, thereby, hazardous materials, e.g., soot and nitrogen oxides, which are the above-described predetermined components., contained in the exhaust gas can be reacted to convert to harmless gases and be discharged to the outside.

Although not shown in the drawing, the plasma reactor of the present embodiment may further include a power supply to apply a voltage to the plasma generation electrode. Previously known power supplies can be used as this power supply insofar as the electricity capable of effectively generating a plasma can be supplied.

The plasma reactor of the present embodiment may have a configuration, in which the current is supplied from an external power supply, rather than the above-described configuration in which the power supply is included.

The current to be supplied to the plasma generation electrode used in the present embodiment can be selected and determined appropriately in accordance with the intensity of the plasma to be generated. For example, in the case where the plasma reactor is disposed in an exhaust system of an automobile, preferably, the current supplied to the plasma generation electrode is a direct current at a voltage of 1 kV or more, a pulse current with a peak voltage of 1 kV or more and the number of pulses per second of 100 or more (100 Hz or more), an alternating current with a peak voltage of 1 kV or more and a frequency of 100 or more (100 Hz or more), or a current produced by superimposing any two of them. According to such a configuration, a plasma can be generated efficiently.

Figure 11:
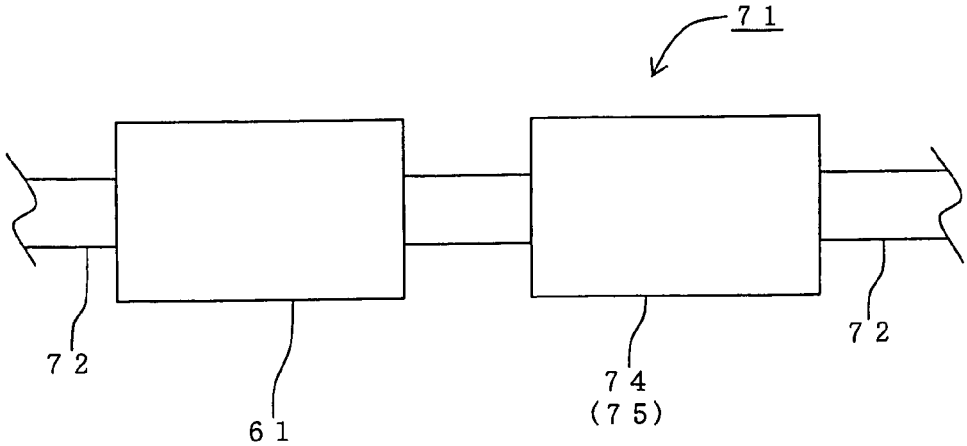
FIG. 11 is an explanatory diagram schematically showing an exhaust gas cleaning apparatus according to an embodiment of the present invention.
Figure 12A:
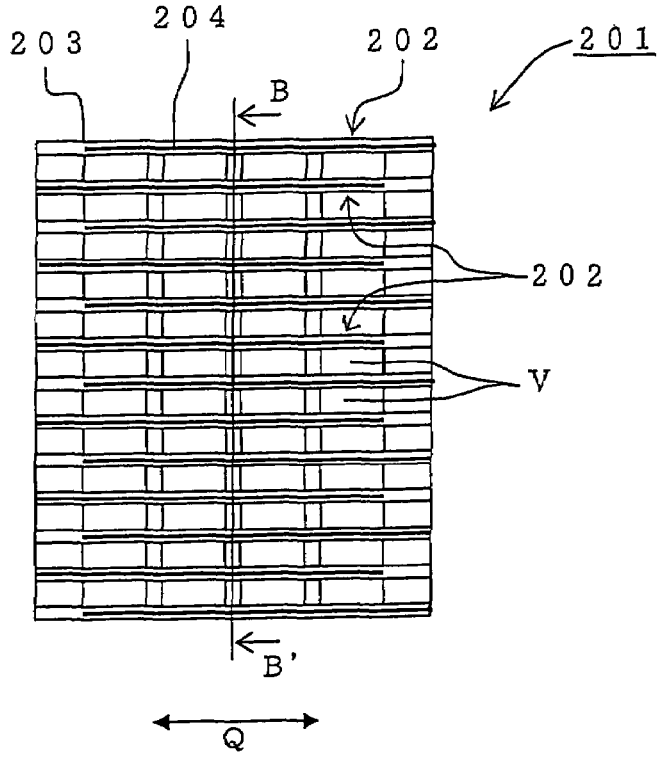
FIGS. 12(*a*)(*b*) schematically show a known plasma generation electrode, FIG. 12(*a*) is a sectional view of the section cut along a plane perpendicular to one direction (gas passing direction), and FIG. 12(*b*) is a sectional view of the section taken along a line B-B' shown in FIG. 12(*a*)
Figure 12B:
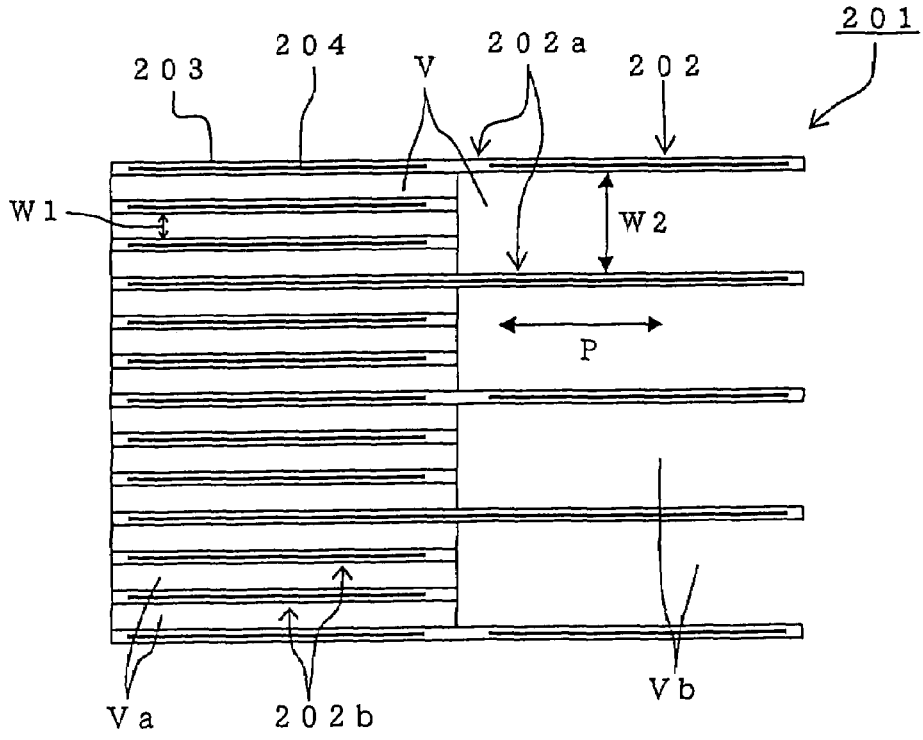
Figure 13A:
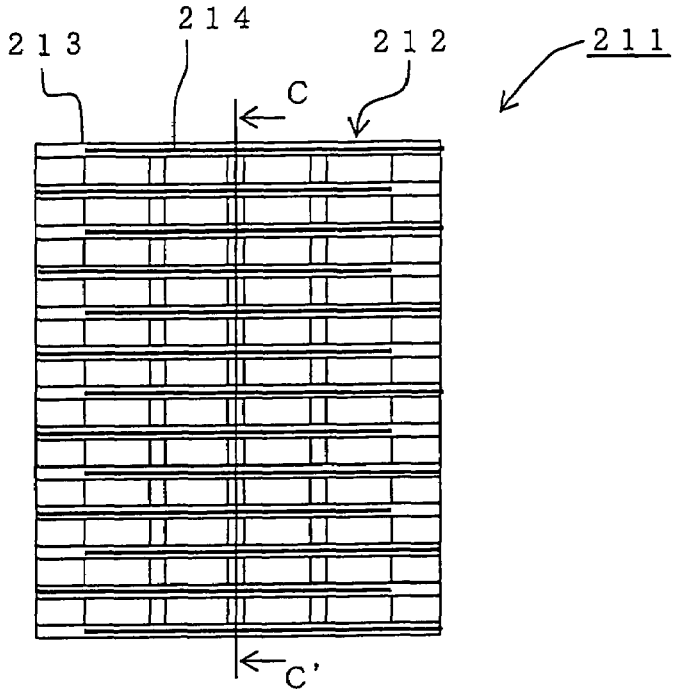
FIGS. 13(*a*) (*b*) schematically show a known plasma generation electrode, FIG. 13(*a*) is a sectional view of the section cut along a plane perpendicular to one direction (gas passing direction), and FIG. 13(*b*) is a sectional view of the section taken along a line C-C' shown in FIG. 13(*a*).
Figure 13B:
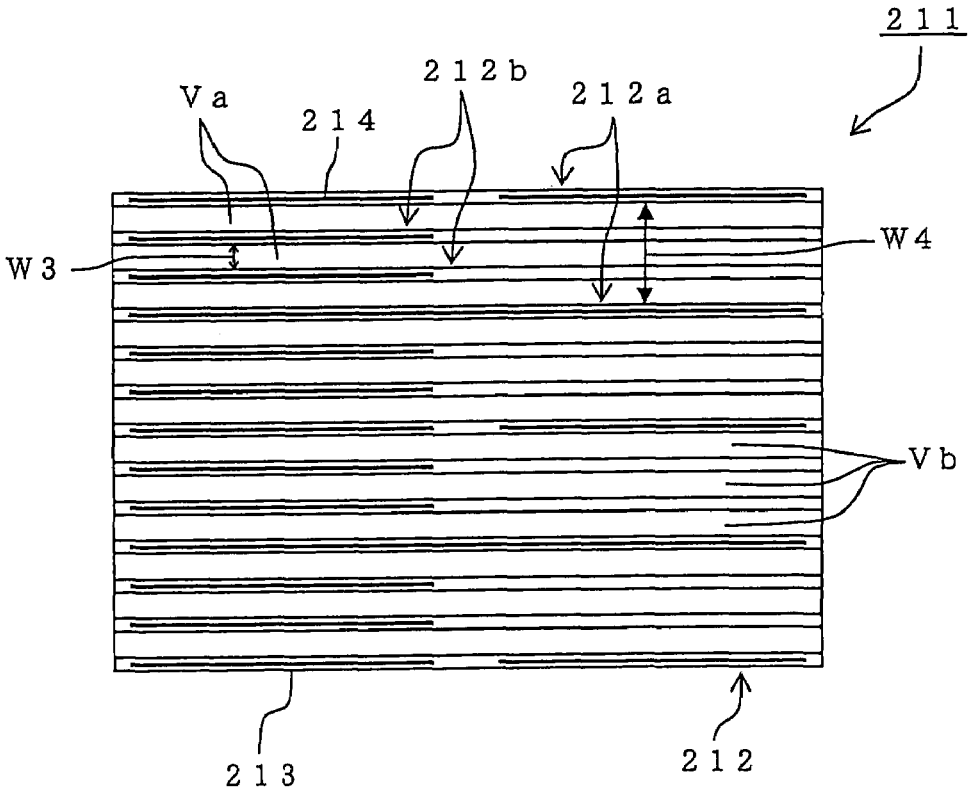

An exhaust gas cleaning apparatus according to an embodiment of the present invention will be specifically described below. FIG. 11 is an explanatory diagram schematically showing an exhaust gas cleaning apparatus according to an embodiment of the present invention. As shown in FIG. 11, an exhaust gas cleaning apparatus 71 of the present embodiment includes the above-described plasma reactor 61 according to an embodiment of the present invention and a catalyst 74. This plasma reactor 61 and the catalyst 74 constitute the exhaust gas cleaning apparatus 71 disposed in the inside of an exhaust system of an internal-combustion engine. The plasma reactor 61 is disposed on the exhaust gas generation side (upstream side) of the exhaust system, and the catalyst 74 is disposed on the exhaustion side (downstream side) thereof. The plasma reactor 61 and the catalyst 74 are connected to each other through the piping 72.

The exhaust gas cleaning apparatus 71 of the present embodiment is, for example, an apparatus for cleaning up $NO_X$ in an exhaust gas under an excess oxygen atmosphere. That is, by a plasma generated in the plasma reactor 61, $NO_X$ is modified in such a way as to become easy to clean up with the catalyst 74 on the downstream side or hydrocarbon (HC) and the like in the exhaust gas are modified in such a way as to become easy to react with $NO_X$ and, thereafter, $NO_X$ is cleaned up with the catalyst 74.

The plasma reactor 61 used in the exhaust gas cleaning apparatus 71 of the present embodiment is to convert $NO_X$ in an exhaust gas resulting from combustion under an excess oxygen atmosphere in lean burn, a direct-injection gasoline engine, a diesel engine, or the like to $NO_2$ by the plasma. The plasma reactor 61 is to generate active species from HC and the like in the exhaust gas, and those having configurations similar to the plasma reactor 61 shown in FIG. 10 can be used favorably.

The catalyst 74 is disposed as a catalyst unit 75 provided with a catalyst component including a support, in which a plurality of pores for passing an exhaust gas are disposed in the inside, on the downstream side of the plasma reactor 61 in the exhaust system. The catalyst component includes a support and a catalyst layer disposed covering the inner wall surface surrounding the plurality of pores of the support.

Since the catalyst layer is produced by immersing the support in a slurry-like catalyst (a catalyst slurry), as described below, the catalyst layer may be referred to as "a wash coat (layer)".

The shape of the support is not specifically limited in the present invention insofar as the support has a space for passing an exhaust gas. In the present embodiment, a honeycomb-shaped support including a plurality of pores is used.

Preferably, the support is formed from a material having heat resistance. Examples of the above-described material include porous materials (ceramic), e.g., cordierite, mullite, silicon carbide (SiC), and silicon nitride ($Si_3N_4$) and metals (for example, stainless steel).

The catalyst layer is formed in such a way that the key portion is the combination of a porous carrier and at least one type selected from Pt, Pd, Rh, Au, Ag, Cu, Fe, Ni, Ir, Ga, and the like held on the surface of the porous carrier. A plurality of continuous pores connected to pores in the support are disposed in the inside of the catalyst layer.

The porous carrier can be formed through appropriate selection and use of alumina, zeolite, silica, titania, zirconia, silica alumina, ceria, or the like. A catalyst facilitating the decomposition reaction of $NO_X$ is used as the catalyst 74.

It is possible to use for removing hazardous materials contained in engine exhaust gases and various incinerator exhaust gases. In particular, it is possible to favorably use for an exhaust gas treatment apparatus with low installation cost and small energy loss, as well as a constituent element thereof.

What is claimed is:

1. A plasma generation electrode comprising:

a plurality of planar unit electrodes hierarchically layered in a vertical direction at a predetermined spacing, and spaces, which are disposed between the unit electrodes and in which at least one end in a horizontal direction gas passing direction is opened and both ends of the other direction are closed, the plasma generation electrode being capable of generating plasmas in the spaces by application of a voltage between the unit electrodes, wherein the plasma is generated in a gas between the unit electrodes, the unit electrode is composed of a tabular ceramic material serving as a dielectric material and an electrically conductive film disposed in the inside of the ceramic material;

the plurality of unit electrodes are layered at a constant spacing;

the distance between the electrically conductive films disposed in the unit electrodes adjacent to each other is varied partly or the dielectric constant of the ceramic material constituting the unit electrode is varied partly; and plasmas having different intensities can be generated partly in the spaces.

2. The plasma generation electrode according to claim 1, wherein the dielectric constant of the ceramic material in the portion from the one end side up to a 10-percent to 90-percent point of the entire length of each of the unit electrodes in the gas passing direction is different from the dielectric constant of the ceramic material in the remaining portion of the unit electrode.

3. The plasma generation electrode according to claim 1, wherein the distance between the electrically conductive films adjacent to each other in the portion from the one end side up to a 10-percent to 90-percent point of the entire length in the gas passing direction is different from the distance between the electrically conductive films adjacent to each other in the remaining portion.

4. The plasma generation electrode according to claim 3, wherein with respect to the electrically conductive films in the remaining portion, the distance between the electrically conductive films adjacent to each other is further varied partly.

5. The plasma generation electrode according to claim 1, wherein at least a part of successive three layers of unit electrodes are disposed in such a way that the distance between an electrically conductive film disposed in a unit electrode (second unit electrode) constituting the middle layer and an electrically conductive film disposed in a unit electrode (first unit electrode) constituting the layer on one surface side of the second unit electrode is different from the distance between the electrically conductive film disposed in the second unit electrode and an electrically conductive film disposed in a unit electrode (third unit electrode) constituting the layer on the other surface side of the second unit electrode, one end side in the gas passing direction of a space (first space) disposed between the first unit electrode and the second unit electrode is closed and the other end side in the gas passing direction of a space (second space) disposed between the second unit electrode and the third unit electrode is closed, at least one through hole in the direction of the normal is disposed in the second unit electrode, and a gas is allowed to enter from the non-closed end side of the first space, pass the through hole, and exit from the non-closed end side of the second space.

6. The plasma generation electrode according to claim 1, wherein the distance between the electrically conductive films adjacent to each other is constant throughout the electrically conductive films, and the distance between a part of the electrically conductive films adjacent to each other is different from the distance between the other electrically conductive films adjacent to each other.

7. A plasma reactor comprising the plasma generation electrode according to claim 1, wherein when a gas containing predetermined components is introduced into the spaces disposed between the plurality of unit electrodes constituting the plasma generation electrode, the predetermined components in the gas can be reacted by plasmas generated in the spaces.

8. The plasma reactor according to claim 7, wherein when the gas containing the predetermined components is introduced into the spaces, each of the gas components is reacted in a portion where the intensity of a plasma is suitable for the reaction of each of the gas components, while plasmas having different intensities are generated partly in the spaces.

9. An exhaust gas cleaning apparatus comprising the plasma reactor according to claim 7 and a catalyst, wherein the plasma reactor and the catalyst are disposed in the inside of an exhaust system of an internal-combustion engine.

10. The plasma generation electrode according to claim 1, wherein the distance between the electrically conductive films disposed in the unit electrodes adjacent to each other is varied partly by a change in the relative positioning within the ceramic material of at least a portion of one of the electrically conductive films.

11. The plasma generation electrode according to claim 1, wherein the distance between the electrically conductive films disposed in the unit electrodes adjacent to each other is varied partly by a difference in a distance between electrically conductive films adjacent to each other and another distance between other electrically conductive films adjacent to each other.

* * * * *